US011753709B2

(12) United States Patent
Lee et al.

(10) Patent No.: US 11,753,709 B2
(45) Date of Patent: Sep. 12, 2023

(54) HOT-DIP GALVANIZED STEEL MATERIAL HAVING EXCELLENT WELDABILITY AND PRESS WORKABILITY AND MANUFACTURING METHOD THEREFOR

(71) Applicant: POSCO, Pohang-si (KR)

(72) Inventors: Suk-Kyu Lee, Gwangyang-si (KR); Sang-Heon Kim, Gwangyang-si (KR); Kwang-Tai Min, Gwangyang-si (KR); Yon-Kyun Song, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 895 days.

(21) Appl. No.: 16/471,289

(22) PCT Filed: Dec. 21, 2017

(86) PCT No.: PCT/KR2017/015292
§ 371 (c)(1),
(2) Date: Jun. 19, 2019

(87) PCT Pub. No.: WO2018/117714
PCT Pub. Date: Jun. 28, 2018

(65) Prior Publication Data

US 2020/0017946 A1 Jan. 16, 2020

(30) Foreign Application Priority Data

Dec. 22, 2016 (KR) ..... 10-2016-0177190

(51) Int. Cl.
*C23C 2/06* (2006.01)
*C22C 18/00* (2006.01)
*C23C 2/26* (2006.01)

(52) U.S. Cl.
CPC ..... *C23C 2/06* (2013.01); *C22C 18/00* (2013.01); *C23C 2/26* (2013.01)

(58) Field of Classification Search
None
See application file for complete search history.

(56) References Cited

U.S. PATENT DOCUMENTS 3,505,043 A 4/1970 Lee et al.
2011/0017362 A1 1/2011 Warnecke et al.
(Continued)

FOREIGN PATENT DOCUMENTS

CN 105917026 8/2016
EP 3396008 10/2018
(Continued)

OTHER PUBLICATIONS

Chinese Office Action—Chinese Application No. 201780080060.0 dated Sep. 10, 2020.
(Continued)

*Primary Examiner* — Brian D Walck
(74) *Attorney, Agent, or Firm* — CANTOR COLBURN LLP

(57) ABSTRACT

Provided are a hot-dipped galvanized steel material and a method for manufacturing the same. The hot-dipped galvanized steel material comprises an iron substrate and a hot-dipped galvanizing layer formed on the iron substrate, wherein the hot-dipped galvanizing layer comprises, by wt %, 0.01 to 0.5% of Al, 0.01 to 1.5% of Mg, 0.05 to 1.5% of Mn, 0.1 to 6% of Fe, and the balance of Zn and inevitable impurities, with a Zn—Fe—Mn based alloy phase present at the interface between the iron substrate and the hot-dipped galvanizing layer, and an area ratio of the Zn—Fe—Mn-based alloy phase to the hot-dipped galvanizing layer ranging from 1 to 60%.

5 Claims, 3 Drawing Sheets

(56) References Cited

U.S. PATENT DOCUMENTS

| | | | |
|---|---|---|---|
| 2015/0337428 | A1 | 11/2015 | Ooi et al. |
| 2017/0029955 | A1 | 2/2017 | Kim et al. |
| 2018/0363118 | A1 | 12/2018 | Kim |

FOREIGN PATENT DOCUMENTS

| | | | | |
|---|---|---|---|---|
| JP | 01263252 | | 10/1989 | |
| JP | 05306445 | | 11/1993 | |
| JP | 08035050 | | 2/1996 | |
| JP | 08277452 | | 10/1996 | |
| JP | 11140615 | | 5/1999 | |
| JP | 3179401 | | 6/2001 | |
| JP | 2003138359 | | 5/2003 | |
| JP | 2004124187 | | 4/2004 | |
| JP | 2006274406 | | 10/2006 | |
| JP | 2008019465 | | 1/2008 | |
| JP | 2010275632 | | 12/2010 | |
| JP | 2007270181 | | 10/2017 | |
| KR | 20110018701 | | 2/2011 | |
| KR | 20120067145 | | 6/2012 | |
| KR | 20150052376 | | 5/2015 | |
| KR | 20150066339 | | 6/2015 | |
| KR | 101786377 | | 10/2017 | |
| KR | 101819393 | | 1/2018 | |
| WO | 1989009844 | | 10/1989 | |
| WO | 2006002843 | | 1/2006 | |
| WO | WO-2014032779 | A1 * | 3/2014 | ..... C23C 2/02 |
| WO | 2017111484 | | 6/2017 | |

OTHER PUBLICATIONS

Japanese Office Action—Japanese Application No. 2019-533539 dated Aug. 18, 2020.

International Search Report—PCT/KR2017/015292 dated Mar. 22, 2018.

European Search Report—European Application No. 17884229.0, dated Nov. 27, 2019.

* cited by examiner

HOT-DIP GALVANIZED STEEL MATERIAL HAVING EXCELLENT WELDABILITY AND PRESS WORKABILITY AND MANUFACTURING METHOD THEREFOR

TECHNICAL FIELD

The present disclosure relates to a hot-dip galvanized steel material having excellent weldability and press workability and a method of manufacturing the same.

BACKGROUND ART

The hot-dip galvanized steel material has sacrificial corrosion protection characteristics in which zinc (Zn) corrodes earlier than iron (Fe) in a corrosive environment to inhibit corrosion of the steel material since it has lower corrosion potential than iron. Accordingly, demand for the hot-dip galvanized steel material has been increased for vehicles, household appliances, and construction materials.

However, air pollution and worsening of corrosive environments have been increasing due to industrial advancement. In addition, regulation on resources and energy saving have been tightened. Accordingly, there is increasing need for development of a steel material having better corrosion resistance than a zinc-plated steel material according to a related art.

Research into improvement in corrosion resistance, achieved by adding elements such as aluminum (Al), magnesium (Mg), and the like, to a zinc plating bath, has been variously conducted to improve corrosion resistance. Galvalume, a typical zinc alloy-based plated steel material, includes 55 wt % of Al and 1.6 wt % of silicon (Si). Since a plating bath should be maintained at a temperature of 600° C. or higher to prepare Galvalume, erosion of a base material and formation of an iron-zinc alloy phase may lead to deterioration in plating quality. Moreover, since plating workability may be lowered, and corrosion of facilities inside the plating bath, such as a sink roll, may be accelerated, the lifespan of the facilities may be shortened.

Research into a technology for manufacturing a Zn—Al—Mg hot-dip zinc alloy-plated steel sheet, in which Mg is further added to a Zn—Al plating composition as another zinc alloy-based plating material, has been actively conducted. For example, Patent Documents 1 and 2 disclose a method of manufacturing a hot-dip zinc alloy-plated steel sheet having corrosion resistance and manufacturing characteristics improved by mixing various additive elements in a plating bath, containing Al and Mg, or regulating manufacturing conditions.

Since Mg is lighter than Zn, a main element of plating composition, and has a high degree of oxidation, a large amount of Mg may float up to an upper portion of a plating bath during a hot-dip process and the floated Mg may be exposed to the atmosphere on a surface of the plating bath to have an oxidation reaction to cause a large amount of dross. Such dross may be adhered to a steel material, dipped in the plating bath, during a plating process to cause a dross defect. Accordingly, a surface defect of a plated layer, formed on the steel material, may be induced and it may be impossible to perform a plating operation.

In the case of the Zn—Al—Mg hot-dip zinc alloy-plated steel sheet, a fine intermetallic compound may be formed in a plated layer by thermodynamic interaction of Zn, Al, and Mg. A plating technology, in which formation and shaping of such a fine intermetallic compound are regulated to improve corrosion resistance, has been introduced.

As an example, Patent Document 3 discloses a plated steel sheet, including, wt %, 4 to 10% of Al, 1 to 4% of Mg, and inevitable impurities, in which the sum of a Zn/Al/$MgZn_2$ ternary eutectic structure and a pro-eutectic Al single-phase structure is 15 volume % or less. As another example, Patent Document 4 discloses a plated steel sheet, having excellent corrosion resistance and workability. The plated steel sheet includes, by wt %, 0.2 to 2.0% of Al and 3.0 to 10.0% of Mg and has a $MgZn_2$ single-phase structure having an average long diameter of 1 to 200 μm.

However, Patent Document 3 is problematic in that a pro-eutectic Al single-phase structure in a plated layer is formed by maintaining a content of Al to be relatively higher than a content of Mg, and thus, workability and weldability of a plating material may be deteriorated. In Patent Document 4, a content of Mg is maintained to be relatively higher than a content of Al to coarsen a $MgZn_2$ single-phase structure having a hexagonal system. Since the MgZn2 single-phase structure has significantly high hardness, a processed portion and an end surface portion have poor corrosion resistance, for example, cracking occurs in a plated layer when a plating material is processed.

RELATED ART DOCUMENT

Patent Document (Patent Document 1) Japanese Patent Laid-Open Publication No. 1999-140615

(Patent Document 2) International Patent Publication No. WO 2006/002843

(Patent Document 3) Japanese Patent Registration No. 3179401

(Patent Document 4) Japanese Patent Laid-Open Publication No. 2010-275632

DISCLOSURE

Technical Problem

An aspect of the present disclosure is to provide a hot-dip galvanized steel material having excellent weldability and press workability and a method of manufacturing the same.

Technical Solution

According to an aspect of the present disclosure, a hot-dip galvanized steel material includes base steel and a hot-dip galvanized layer disposed on the base steel. The hot-dip galvanized layer includes, by wt %, 0.01 to 0.5% of Al, 0.01 to 1.5% of Mg, 0.05 to 1.5% of Mn, 0.1 to 6% of Fe, and a balance of Zn and inevitable impurities. A Zn—Fe—Mn based alloy phase is present at an interface between the base steel and the hot-dip galvanized layer. A ratio of an area of the Zn—Fe—Mn based alloy phase to an area of the hot-dip galvanized layer is 1% to 60%.

According to another aspect of the present disclosure, a method of manufacturing a hot-dip galvanized steel material includes preparing a hot-dip galvanizing bath comprising, by wt %, 0.01 to 0.15% of Al, 0.01 to 1.0% of Mg, 0.05 to 1.5% of Mn, and a balance of Zn and inevitable impurities, dipping base steel, maintained at a temperature of 440 to 540° C., in the hot-dip galvanizing bath to obtain a hot-dip galvanized steel sheet, and gas-wiping and cooling the hot-dip galvanized steel sheet.

Advantageous Effects

As an advantageous effect of various effect of the present invention, a hot-dip galvanized steel material according to the present disclosure may have excellent weldability and process workability.

Various useful advantages and effects may not be limited to the above-described effects, and may be more easily understood through a process in which specific embodiments of the present disclosure are described.

BEST MODE FOR INVENTION

Figure 1:
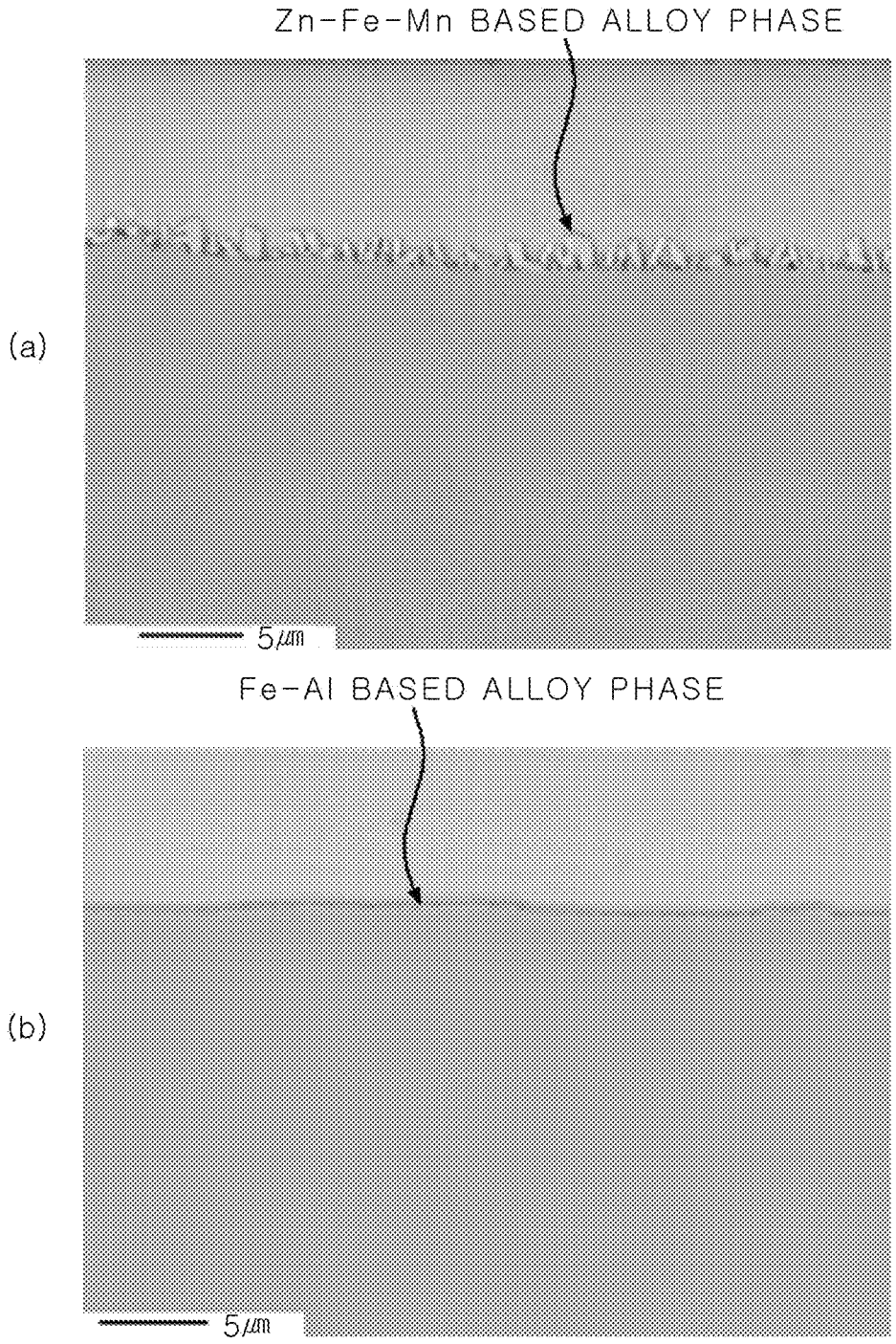
FIG. 1 is (a) an SEM image observing a hot-dip galvanized layer of Inventive Example 13, and (b) an SEM image observing a hot-dip galvanized layer of Comparative Example 2.

Hereinafter, a hot-dip galvanized steel material having excellent weldability and press workability, an aspect of the present disclosure, will be described in detail.

A hot-dip galvanized steel material, an aspect of the present disclosure, includes base steel and a hot-dip galvanized layer. In the present disclosure, type of the base steel is not limited and may be, for example, a steel sheet or a steel wire. Further, in the present disclosure, alloying components and a content range of the base steel are not limited. However, it is necessary to control a content of P, an inevitably contained impurity, among the alloying components. This is because P in the base steel inhibits formation of the Zn—Fe—Mn based alloy phase. When the content of P in the base steel is excessive, it may be difficult to form the Zn—Fe—Mn based alloy phase. Therefore, the content of P in the base steel needs to be controlled as low as possible, in detail, less than 0.01%, in further detail, 0.009% or less, and, in much further detail, 0.008% or less. As the content of P is decreased, a Zn—Fe—Mn based alloy phase is more surely formed, and thus, a lower limit of the content of P is not limited.

Hereinafter, alloying components and content ranges of a hot-dip galvanized layer will be described in detail. It is to be noted in advance that the content of each component described below is on the basis of wt % unless otherwise specified.

Al: 0.01 to 0.5%

Aluminum (Al) may play a role in inhibiting the formation of dross in a plating bath during a manufacturing process of a plated steel material. It is well known that Al forms a Fe—Al based alloy phase on an interface between base steel and a hot-dip galvanized layer to improve platability. However, since the present disclosure is aimed at forming a Zn—Fe—Mn based alloy phase rather than a Fe—Al based alloy phase, a content of Al needs to be slightly low and is limited to 0.5% or less. When the content of Al is excessively low, an effect of inhibiting dross in a plating bath may be insufficient and the Zn—Fe—Mn based alloy phase may be excessively formed to deteriorate workability. Al and Fe react with each other to form an inhibition layer. Therefore, diffusion of Fe may be significantly increased when the content of Al is significantly low. Thus, reaction of diffused Fe with Zn may be increased to make an alloy layer excessive. Therefore, a lower limit of the content of Al may be limited to 0.01%. According to an example embodiment, the content of Al may be determined to be 0.08 to 0.15%.

Mg: 0.01 to 1.5%

Magnesium (Mg) is an element playing an important role in improving corrosion resistance of a plated layer. Mg, included in the plated, may inhibit growth of zinc oxide-based corrosion products having a low corrosion property improving effect in harsh corrosive environments, and may stabilize zinc hydroxide-based corrosion products having a high corrosion resistance improving effect on a surface of the plate layer. In order to achieve the effects, Mg may be included in an amount of, 0.01% or more. When a content of Mg is excessive, oxidized dross of Mg may be excessively formed to cause a dross defect. Therefore, an upper limit may be limited to 1.5%. According to an example embodiment, the content of Mg may be determined to be 0.08 to 0.15%. According to an example embodiment, a ratio of the content of Mg to the content of Al (% Mg:% Al) may be 0.8:1 to 1.2:1.

Mn: 0.05 to 1.5%

Manganese (Mn) may play a role in increasing hardness of a hot-dip galvanized layer to improve press workability. When Mg is solely added to a plated layer, a Fe—Zn reaction may be inhibited. On the other hand, when an appropriate amount of Mn is added together with Mg, Fe—Zn alloying may be promoted, and a part of Fe may be substituted with Mn to form a Zn—Fe—Mn alloy phase on an interface between base steel and the hot-dip galvanized layer. As described above, when the Zn—Fe—Mn base alloy phase, rather than a Fe—Al based alloy phase, is formed on the interface between base steel and the hot-dip galvanized layer, weldability of a plated steel material may be significantly improved. In order to achieve such an effect, Mn may be included in an amount of, in detail, 0.05% or more. When the content of Mn is excessive, corrosion resistance of the plated steel material may be deteriorated. Therefore, an upper limit of the content of Mn is limited to 1.5%. In an example embodiment, the content of Mn may be 0.1 to 0.5%.

Fe: 0.1 to 6%

Iron (Fe) is an element inevitably introduced in a process of manufacturing a plated steel material. When a content of Fe is significantly low, formation of the Zn—Fe—Mn based alloy phase may be inhibited to deteriorate weldability. Meanwhile, when the content of Fe is significantly high, an excessive Zn—Fe—Mn based alloy phase may be formed to peel off a plated layer. Therefore, a content of Fe is limited to 0.1 to 6%. According to an example embodiment, the content of Fe may be determined to be 0.5 to 3%. According to an example embodiment, Fe may be diffused from a base steel sheet to be included in the plated layer.

A residual component is zinc (Zn) in addition to the above-described alloying components. However, since unintended impurities may be inevitably incorporated from raw materials or surrounding environments in a usual manufacturing process, they may not be excluded. Since such impurities are known to those skilled in the art, the entire contents thereof are not specifically mentioned in the present specification.

Addition of an effective component, in addition to the above-described composition, is not excluded. For example, 0.0001 to 1 wt % in total of one or more selected from a group consisting of K, Ca, and Li may be further included. Since the above elements have a lower electronegativity than Fe, corrosion resistance of a plated steel material may be further improved when these elements are included in the plated layer. According to an example embodiment, the sum of the contents of the above elements may be set to 0.5% or less.

A Zn—Fe—Mn based alloy phase is present at an interface between base steel and a zinc-based plated layer. As described above, a main feature of the present disclosure is that rather than a typical Fe—Al based alloy phase, a Zn—Fe—Mn alloy phase is present at an interface between base steel and a zinc-based plated layer. Accordingly, weldability of a plated steel material may be significantly improved. In the present disclosure, detailed type of the Zn—Fe—Mn based ally phase is not limited. According to an example, the Zn—Fe—Mn based alloy phase may be (Fe, Mn) $Zn_7$.

According to an example, a ratio of an area of the Zn—Fe—Mn based alloy phase to an area of a hot-dip galvanized layer may be 1% to 60%. When the Zn—Fe—Mn based alloy phase is formed to have a significantly small area, it may be difficult to secure desired weldability. Meanwhile, when the Zn—Fe—Mn based alloy phase is formed to have a significantly large area, it may be difficult to secure desired press workability and surface quality may be deteriorated. Corrosion resistance after plating may also be deteriorated. Accordingly, it is necessary to appropriately manage the area of the Zn—Fe—Mn based alloy phase. According to an example embodiment, a ratio of the area of the Zn—Fe—Mn based alloy phase to the area of the hot-dip galvanized layer may be 5% to 15%.

In the present disclosure, coating weight of the hot-dip galvanized layer is not limited. According to an unlimited example, coating amount of the hot-dip galvanized layer may be 10 to 200 $g/m^2$ at one side. When the one-side coating weight of the hot-dip galvanized layer is less than 10 $g/m^2$, it is difficult to secure good corrosion property, when the one-side coating weight of the hot-dip galvanized layer is more than 200 $g/m^2$, an economical disadvantage may arise. According to an example embodiment, the coating weight may be determined within a range from 30 to 60 $g/m^2$.

The above-described hot-dip galvanized steel material may be manufactured using various methods, but a method of manufacturing the hot-dip galvanized steel material is not limited. As an example, the hot-dip galvanized steel material may be manufactured using a method described below.

Hereinafter, a method of manufacturing a hot-dip galvanized steel material having excellent weldability and press workability, another aspect of the present disclosure, will be described in detail.

According to an example embodiment, a hot-dip galvanizing bath, including, by wt %, 0.01 to 0.15% of Al, 0.01 to 1.0% of Mg, 0.05 to 1.5% of Mn, and a balance of Zn and inevitable impurities, is prepared. Due to the reasons described above, Al, Mg, and Mn are added to the hot-dip plating bath. However, it is to be noted that an upper limit of a content of Al is 0.15%. It is because elements such as Al, Mg, and the like, may be first picked up to a plated layer in a plating process, and thus, contents of the elements may be higher than contents of the elements in the hot-dip plating bath.

In a typical process of manufacturing a galvanized steel (GI) material, a content of Al in a hot-dip plating bath is managed to be 0.16 wt % or more. In this case, rather than a Zn—Fe—Mn based alloy phase, a Fe—Al based alloy phase is formed to deteriorate weldability. Therefore, an upper limit of Al may be determined as described above. Due the reasons described above, the hot-dip plating bath may further include 0.0001 to 1 wt % in total of one or more selected from a group consisting of K, Ca, and Li.

Next, base steel, maintained at a temperature of 440 to 540° C., is dipped into a hot bath to obtain a hot-dip galvanized steel sheet. When an inlet temperature of the base steel is lower than 440° C., a Zn—Fe—Mn based alloy phase may not be formed. Meanwhile, when the inlet temperature of the base steel is higher than 540° C., the Fe—Mn—Zn based alloy phase may be excessively grown to cause peeling off of plated layer in working.

According to an example embodiment, the plated layer needs to be cooled as slow as possible at an average cooling rate of 1 to 2° C./s in a section in which a temperature of the plated layer ranges from 460 to 400° C. By controlling the cooling rate as described above, a portion of a Zn—Fe—Mn based interface alloy phase may be optimized within a range of the present disclosure. When a temperature of the plating bath is 460° C. or less, the temperature section may refer to a section between the temperature of the plating bath and 400° C. According to another example embodiment, in a temperature section in which the temperature of the plated layer ranges from 400 to 300° C., an average cooling rate may be 5° C./s or higher. By controlling the average cooling rate as described above, zinc pickup to a top roll may be prevented from occurring. It is unnecessary to determine an upper limit of the cooling rate in the temperature section, but the upper limit of the cooling rate may be determined to be 15° C./s in consideration of line speed and the like in production.

Next, the hot-dip galvanized steel sheet is gas-wiped and cooled. A gas wiping treatment may be performed to adjust coating weight, and a method thereof is not limited. A gas, used in the gas wiping treatment, may be air or nitrogen and may be, in detail, nitrogen. This is because, when air is used in the gas wiping treatment, Mg may be first oxidized on a surface of the plated layer to cause a surface defect of the plated layer.

In the present disclosure, a cooling rate and a finish cooling temperature are not limited during the cooling and may depend on conventional cooling conditions. A cooling method may not be limited during the cooling, either. For example, the cooling may be performed by using an air jet cooler, by $N_2$ wiping, or by spraying water fog or the like.

Mode for Invention

In the description below, an example embodiment of the present disclosure will be described in greater detail. It should be noted that the example embodiments are provided to describe the present disclosure in greater detail, and to not limit the present disclosure. The scope of right of the present disclosure may be determined based on the matters recited in the claims and the matters rationally inferred therefrom.

Embodiment

As base steel, a low-carbon cold-rolled steel sheet, having a thickness of 0.8 mm, a width of 100 mm, and a length of 200 mm, including, by wt %, 0.0018% of C, 0.01% of P, 0.7% of Mn, 0.02% of Ti, 0.02% of Nb, and 0.03% of Al, was prepared as a specimen for plating. The base steel was dipped in acetone and ultrasonically cleaned to remove foreign substances such as rolling oil present on a surface thereof. Before plating was performed, all specimens was subjected to a heat treatment in a reducing atmosphere at 750° C. to secure mechanical properties of a steel sheet at a general hot-dip plating site. Then, the base steel was dipped in a plating bath, having a composition listed in Table 1, to be plated. Except for a temperature of a plating bath and a temperature of base steel dipped in the plating bath, the same plating conditions were applied to all examples. A temperature of a plating bath was adjusted to 440 to 600° C. in consideration of a rise in a melting point depending on a content of Al. Temperatures of base steels, dipped in plating bath, were listed in Table 1. After termination of plating, coating amount was adjusted to be 70 g/m$^2$ per one side using $N_2$ gas wiping and then cooled. In a temperature section in which a temperature of the plated layer ranges from 460 to 400° C., a cooling rate of the plated layer was controlled to be 1.5° C./s. Thereafter, the cooling rate ranging from 400 to 300° C. was 10° C./s.

A composition of the plated layer of the manufactured hot-dip galvanized steel sheet was analyzed and was listed in Table 1.

A determination was visually made as to whether there is a dross defect, Vickers hardness was measured under a load of 1 g, weldability and corrosion resistance were evaluated, and results thereof were listed in Table 2. More specifically, for evaluation of the weldability, the number of spots, required for a nugget size to reach 4 mm after spot welding, was measured under pressing force of 270 MPa, welding time of 3 cycles, and welding current of 5.0 kA. For evaluation of the corrosion resistance, occurrence time of 5% of red rust after a salt spraying standard test, corresponding to KS-C-0223, was measured.

TABLE 1

| | Composition of Plating Bath (wt %) | | | | Temperature of Plating Bath | Inlet Temperature of Base Steel | Composition of Plated Layer (wt %) | | | | |
|---|---|---|---|---|---|---|---|---|---|---|---|
| Note | Al | Mg | Mn | etc. | (° C.) | (° C.) | Al | Mg | Mn | Fe | etc. |
| IE 1 | 0.01 | 0.01 | 0.05 | | 460 | 440 | 0.01 | 0.015 | 0.05 | 5.5 | |
| IE 2 | 0.01 | 0.02 | 0.05 | | 460 | 460 | 0.02 | 0.03 | 0.05 | 6 | |
| IE 3 | 0.1 | 0.1 | 0.05 | | 460 | 500 | 0.2 | 0.15 | 0.05 | 3.5 | |
| IE 4 | 0.1 | 1 | 0.05 | | 460 | 480 | 0.2 | 1.5 | 0.05 | 3.2 | |
| IE 5 | 0.1 | 1 | 0.5 | | 460 | 480 | 0.2 | 1.5 | 0.5 | 3.2 | |
| IE 6 | 0.1 | 1 | 1 | | 460 | 480 | 0.2 | 1.5 | 1 | 3.2 | |
| IE 7 | 0.13 | 0.5 | 1.5 | | 460 | 480 | 0.3 | 0.75 | 1.5 | 2.5 | |
| IE 8 | 0.13 | 0.13 | 0.05 | | 460 | 480 | 0.3 | 0.195 | 0.05 | 2.5 | |
| IE 9 | 0.13 | 0.5 | 0.5 | | 460 | 480 | 0.3 | 0.75 | 0.5 | 2.5 | |
| IE 10 | 0.13 | 1 | 0.5 | | 460 | 480 | 0.3 | 1.5 | 0.5 | 2.5 | |
| IE 11 | 0.13 | 1 | 1.5 | | 460 | 480 | 0.3 | 1.5 | 1.5 | 2.5 | |
| IE 12 | 0.15 | 0.5 | 0.5 | | 460 | 500 | 0.4 | 0.75 | 0.5 | 0.1 | |
| IE 13 | 0.15 | 1 | 1 | | 460 | 520 | 0.5 | 1.5 | 1 | 0.2 | |
| IE 14 | 0.15 | 1 | 1.5 | | 460 | 540 | 0.5 | 1.5 | 1.5 | 0.3 | |
| IE 15 | 0.13 | 0.13 | 0.05 | K: 0.2 | 460 | 480 | 0.3 | 0.195 | 0.05 | 2.5 | K: 0.2 |
| IE 16 | 0.13 | 0.13 | 0.05 | Ca: 0.1 | 460 | 480 | 0.3 | 0.195 | 0.05 | 2.5 | Ca: 0.1 |
| IE 17 | 0.13 | 0.13 | 0.05 | LI: 0.1 | 460 | 480 | 0.3 | 0.195 | 0.05 | 2.5 | Li: 0.1 |
| CE 1 | 0.005 | 0.01 | 0.05 | | 460 | 480 | 0.008 | 0.015 | 0.05 | 6.2 | |
| CE 2 | 0.01 | 0.005 | 0 | | 460 | 440 | 0.01 | 0.0075 | 0 | 5.5 | |
| CE 3 | 0.01 | 0.005 | 0.03 | | 460 | 480 | 0.02 | 0.0075 | 0.03 | 5.8 | |
| CE 4 | 0.13 | 0.005 | 1 | | 460 | 500 | 0.3 | 0.0075 | 1 | 3.1 | |
| CE 5 | 0.13 | 1.2 | 1.5 | | 460 | 500 | 0.3 | 1.8 | 1.5 | 3.1 | |
| CE 6 | 0.13 | 1.2 | 0.5 | | 460 | 500 | 0.3 | 1.8 | 3 | 3.1 | |
| CE 7 | 0.13 | 1.2 | 1.7 | | 460 | 560 | 0.3 | 1.8 | 1.7 | 3.1 | |
| CE 8 | 0.16 | 0.01 | 0.05 | | 460 | 480 | 0.55 | 0.015 | 0.05 | 0.06 | |
| CE 9 | 0.16 | 1 | 1.5 | | 460 | 540 | 0.7 | 1.5 | 1.5 | 0.08 | |
| CE 10 | 0.16 | 1 | 1.5 | | 460 | 430 | 0.6 | 1.5 | 1.5 | 0.03 | |
| CE 11 | 0.16 | 1 | 1.5 | | 460 | 550 | 0.7 | 1.5 | 1.5 | 0.09 | |

IE: Inventive Example,
CE: Comparative Example

TABLE 2

| | Fe—Mn—Zn Alloy Phase at the interface between Base Steel and Plated Layer | Plating Properties | | | | |
|---|---|---|---|---|---|---|
| Note | Formed (○, x) | Area Rate (%) | Number of spots | Dross Defect | Occurrence Time of Red Rust (hr) | Hardness of Plated Layer (Hv) |
| IE 1 | ○ | 55 | 1400 | Not Occur | 440 | 86 |
| IE 2 | ○ | 60 | 1500 | Not Occur | 450 | 85 |
| IE 3 | ○ | 40 | 1300 | Not Occur | 500 | 83 |
| IE 4 | ○ | 30 | 1300 | Not Occur | 630 | 82 |
| IE 5 | ○ | 35 | 1300 | Not Occur | 650 | 82 |
| IE 6 | ○ | 40 | 1300 | Not Occur | 700 | 124 |
| IE 7 | ○ | 30 | 1250 | Not Occur | 550 | 143 |
| IE 8 | ○ | 15 | 1250 | Not Occur | 520 | 80 |
| IE 9 | ○ | 28 | 1250 | Not Occur | 550 | 102 |
| IE 10 | ○ | 20 | 1250 | Not Occur | 700 | 104 |
| IE 11 | ○ | 25 | 1250 | Not Occur | 700 | 146 |
| IE 12 | ○ | 1.5 | 1000 | Not Occur | 550 | 100 |
| IE 13 | ○ | 3 | 1100 | Not Occur | 700 | 120 |
| IE 14 | ○ | 10 | 1150 | Not Occur | 680 | 140 |
| IE 15 | ○ | 15 | 1250 | Not Occur | 650 | 87 |
| IE 16 | ○ | 15 | 1250 | Not Occur | 630 | 85 |
| IE 17 | ○ | 15 | 1250 | Not Occur | 670 | 80 |
| CE 1 | ○ | 90 | 1500 | Not Occur | 80 | 64 |
| CE 2 | x | — | 1400 | Not Occur | 72 | 60 |

TABLE 2-continued

| | Fe—Mn—Zn Alloy Phase at the interface between Base Steel and Plated Layer | | Plating Properties | | | |
|---|---|---|---|---|---|---|
| Note | Formed (○, x) | Area Rate (%) | Number of spots | Dross Defect | Occurrence Time of Red Rust (hr) | Hardness of Plated Layer (Hv) |
| CE 3 | ○ | 80 | 1420 | Not Occur | 72 | 62.4 |
| CE 4 | ○ | 70 | 1290 | Not Occur | 72 | 120 |
| CE 5 | ○ | 0.4 | 1290 | Occur | 750 | 139 |
| CE 6 | ○ | 0.2 | 1290 | Occur | 720 | 98 |
| CE 7 | ○ | 0.7 | 1290 | Occur | 680 | 158 |
| CE 8 | ○ | 0.2 | 500 | Not Occur | 300 | 64 |
| CE 9 | ○ | 0.8 | 520 | Not Occur | 520 | 135 |
| CE 10 | ○ | 0.6 | 450 | Not Occur | 520 | 132 |
| CE 11 | ○ | 0.9 | 530 | Not Occur | 520 | 136 |

IE: Inventive Example,
CE: Comparative Example

As can be seen from Table 2, in the case of Inventive Examples 1 to 14 satisfying both plated layer compositions and manufacturing conditions proposed in the present disclosure, weldability and corrosion resistance are significantly excellent, no dross defect occurred, and hardness of plated layers was high.

Meanwhile, in the case of Comparative Example 1, a content of Al was excessively low and a content of Fe in a plated layer was excessively high, and thus, the plating layer was peeled off during processing. In the case of Comparative Examples 2 to 4, a content of Mg was excessively low, and thus, corrosion resistance was poor. In the case of Comparative Examples 5 to 7, a content of Mg was excessively high, and thus, a dross defect occurred. In Comparative Examples 8 to 11, a content of Al was excessively high, and thus, formation of a Zn—Fe—Mn based alloy phase was inhibited and a Fe—Al based alloy phase was formed. In addition, a content of Fe in a plated layer is low, and thus, weldability was poor. In the case of Comparative Example 10, an inlet temperature of base steel was excessively low, and thus, a Zn—Fe—Mn based alloy phase was not formed well and weldability was poor. In the case of Comparative Example 7, an inlet temperature of base steel was excessively high, and thus, an alloy phase was excessively grown and a plated layer was peeled off in working.

FIG. 1(*a*) is an SEM image observing a hot-dip galvanized layer of Inventive Example 13, and FIG. 1(*b*) is an SEM image observing a hot-dip galvanized layer of Comparative Example 2. Referring to FIG. 1, it can be visually confirmed that in a hot-dip galvanized steel sheet, a Zn—Fe—Mn based alloy phase such as (Fe,Mn) $Zn_7$ or (Fe,Mn) $Zn_{10}$ is uniformly distributed on an interface between base steel and a hot-dip galvanized layer.

Figure 2:
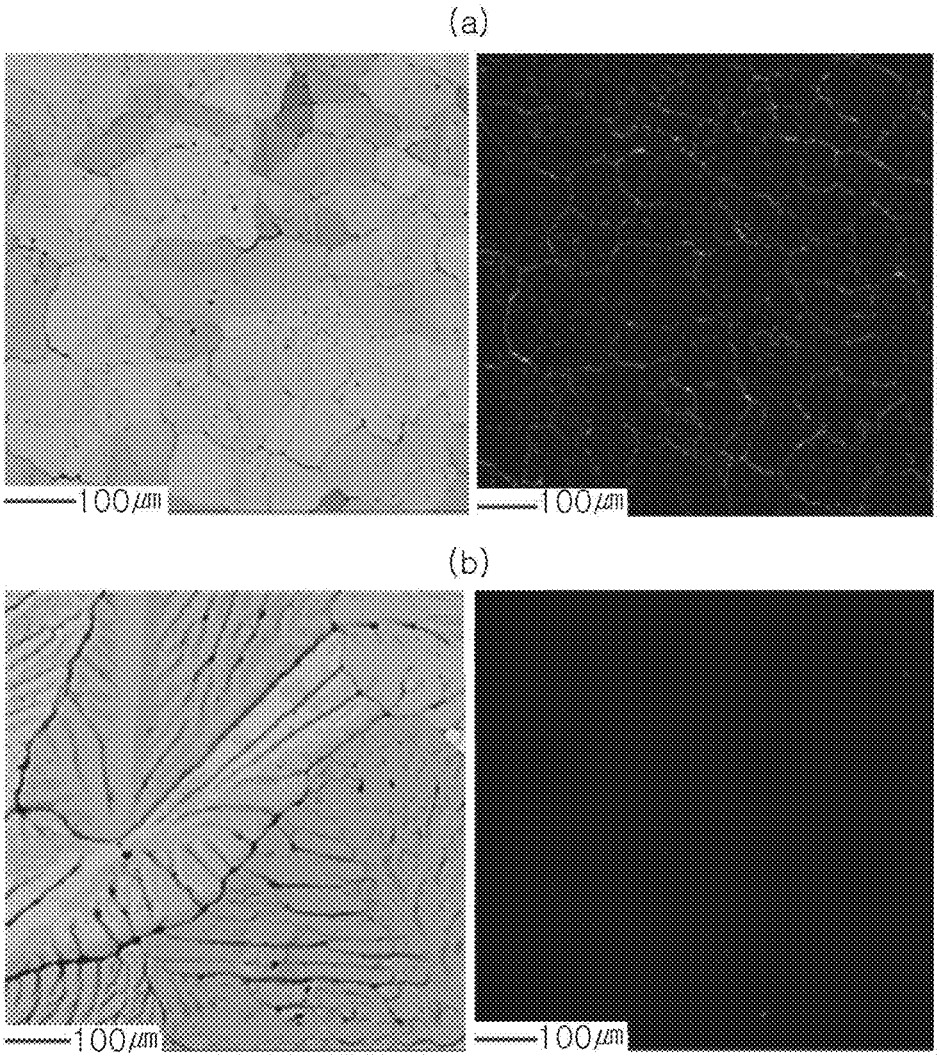
FIG. 2 is (a) an image observing Mg distribution on a surface of the hot-dip galvanized layer of Inventive Example 13 using electron probe microanalysis (EPMA), and (b) an image observing a Mg distribution on a surface of the hot-dip galvanized layer of Comparative Example 2.

FIG. 2(*a*) is an image observing a Mg distribution on a surface of the hot-dip galvanized layer of Inventive Example 13 using electron probe microanalysis (EPMA), and FIG. 2(*b*) is an image observing a Mg distribution on a surface of the hot-dip galvanized layer of Comparative Example 2. Referring to FIG. 2, it can be visually confirmed that in a hot-dip galvanized layer according to the present disclosure, Ma is uniformly distributed on grain boundaries of a surface layer of a plated layer. As described above, when Mg is uniformly distributed on grain boundaries, intergranular corrosion under a corrosive environment is inhibited, and $Mg_2^+$ cations are dissolved, such that stable corrosion products are formed to improve corrosion resistance.

Figure 3:
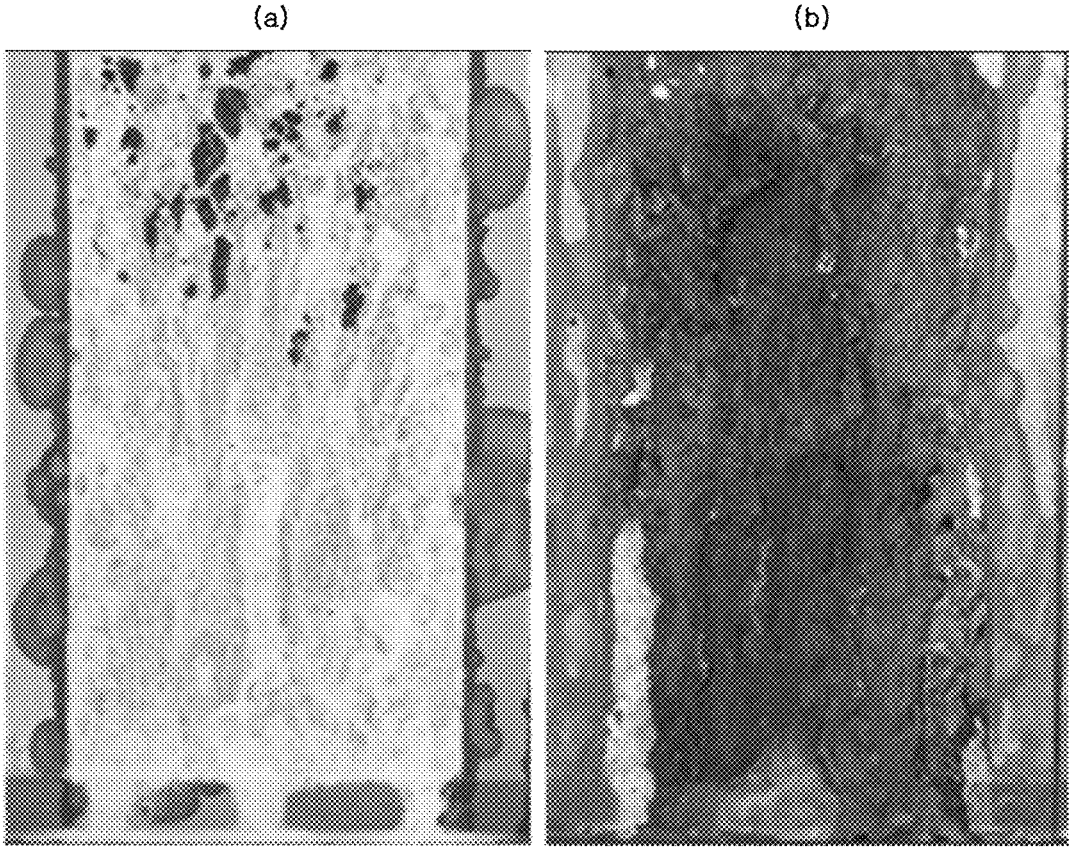
FIG. 3 is (a) an image observing a surface of a hot-dip galvanized steel material of Example 13 after the steel material is subjected to a salt spray test for 700 hours, and (b) an image observing a surface of a hot-dip galvanized steel material of Comparative Example 2 after the steel material is subjected to a salt spray test for 700 hours.

FIG. 3(*a*) is an image observing a surface of a hot-dip galvanized steel material after the steel material is subjected to a salt spray test for 700 hours, and FIG. 3(*b*) is an image observing a surface of a hot-dip galvanized steel material of Comparative Example 2 after the steel material is subjected to a salt spray test for 700 hours. Referring to FIG. 3, it can be visually confirmed that a hot-dip galvanized steel material according to the present disclosure has excellent corrosion resistance.

While example embodiments have been illustrated and described above, it will be apparent to those skilled in the art that modifications and variations could be made without departing from the scope of the present disclosure as defined by the appended claims.

The invention claimed is:

1. A hot-dip galvanized steel material comprising:

base steel and a hot-dip galvanized layer disposed on the base steel, wherein the hot-dip galvanized layer comprise, by wt %, 0.01 to 0.5% of Al, 0.01 to 1.5% of Mg, 0.05 to 1.5% of Mn, 0.1 to 6% of Fe, and a balance of Zn and inevitable impurities, and a Zn—Fe—Mn based alloy phase is present at an interface between the base steel and the hot-dip galvanized layer, and a ratio of an area of the Zn—Fe—Mn based alloy phase to an area of the hot-dip galvanized layer is 1% to 60%.

2. The hot-dip galvanized steel material of claim 1, wherein the Zn—Fe—Mn based alloy phase is (Fe,Mn)$Zn_7$.

3. The hot-dip galvanized steel material of claim 1, wherein the base steel comprises P in an amount less than 0.01%.

4. The hot-dip galvanized steel material of claim 1, wherein the hot-dip galvanized layer further comprises 0.0001 to 1 wt % in total of one or more selected from a group consisting of K, Ca, and Li.

5. The hot-dip galvanized steel material of claim 1, wherein one-side coating amount of the hot-dip galvanized layer is 10 to 200 g/$m^2$.

* * * * *